US009877556B1

(12) United States Patent
Holder

(10) Patent No.: US 9,877,556 B1
(45) Date of Patent: Jan. 30, 2018

(54) MULTI-SLOT ACCESS WALLET

(71) Applicant: Blake Holder, Gilbert, AZ (US)

(72) Inventor: Blake Holder, Gilbert, AZ (US)

( * ) Notice: Subject to any disclaimer, the term of this patent is extended or adjusted under 35 U.S.C. 154(b) by 0 days.

(21) Appl. No.: 15/278,208

(22) Filed: Sep. 28, 2016

(51) Int. Cl.

| | |
|---|---|
| ***A45C 11/14*** | (2006.01) |
| ***A45C 1/06*** | (2006.01) |
| ***B42F 7/06*** | (2006.01) |
| ***A45C 11/18*** | (2006.01) |

(52) U.S. Cl.
CPC ..... *A45C 1/06* (2013.01); *A45C 11/182* (2013.01); *B42F 7/06* (2013.01); *A45C 2001/065* (2013.01); *A45C 2011/186* (2013.01)

(58) Field of Classification Search
CPC ..... A45C 11/14; A45C 11/18; A45C 11/182; A45C 2001/065
USPC ..... 150/131–134; 206/37, 37.1, 37.4, 39.4
See application file for complete search history.

(56) References Cited

U.S. PATENT DOCUMENTS

| | | | | | |
|---|---|---|---|---|---|
| 1,269,247 | A | | 6/1918 | Aslin | |
| 1,580,346 | A | | 4/1926 | Sutter | |
| 1,828,342 | A | * | 10/1931 | Sachs | A45C 3/06 150/101 |
| 2,252,177 | A | | 8/1941 | Heyer | |
| 2,527,175 | A | * | 10/1950 | Brill | A45C 11/32 206/37.1 |
| 2,586,132 | A | | 2/1952 | Whitmer | |
| 2,796,904 | A | * | 6/1957 | Schwenk | A45C 1/06 150/133 |
| 2,802,501 | A | * | 8/1957 | Stember | A45C 13/04 150/101 |
| 3,217,613 | A | * | 11/1965 | Ascarrunz | A45C 1/06 150/132 |
| 3,360,027 | A | * | 12/1967 | Price | A45C 11/18 150/132 |
| 4,010,787 | A | | 3/1977 | Traugott et al. | |
| 5,069,333 | A | * | 12/1991 | Chen | B65D 83/12 150/147 |
| 5,080,223 | A | | 1/1992 | Mitsuyama | |
| 5,195,683 | A | * | 3/1993 | Gaetano | B65D 65/12 206/455 |
| 5,653,276 | A | | 8/1997 | Niernberger | |
| 6,155,410 | A | * | 12/2000 | Davis | A45C 11/182 150/147 |
| D436,724 | S | | 1/2001 | Kojoori | |
| 6,276,414 | B1 | | 8/2001 | Bibb | |
| 6,457,863 | B1 | | 10/2002 | Vassallo | |
| 2008/0023114 | A1 | * | 1/2008 | Bridgefarmer | A45C 1/06 150/147 |

(Continued)

*Primary Examiner* — Sue A Weaver
(74) *Attorney, Agent, or Firm* — Dak J. Ream

(57) ABSTRACT

A multi-slot access wallet includes a substantially rectangular base sheet, one or more intermediate sheets, and a top sheet. Each sheet has a substantially similar configuration having a lower edge, a first side edge perpendicular to the lower edge, an upper edge parallel to the lower edge, and a second side edge parallel to the first side edge that connects ends of the upper and lower edge. An upwardly adjacent sheet is joined to an immediately lower adjacent sheet with three edges being joined together and one edge remaining unjoined so as to form an opening to a pocket defined between respective sheets. Each respective pair of sheets defines an opening and pocket offset by 90 degrees from the prior pair of sheets such that each side of the wallet has a slot opening to a respective pocket.

5 Claims, 7 Drawing Sheets

(56) References Cited

U.S. PATENT DOCUMENTS

| | | | | |
|---|---|---|---|---|
| 2013/0000801 | A1* | 1/2013 | Lee | G06K 19/07327 150/147 |
| 2015/0208778 | A1* | 7/2015 | Velentzas | A45C 11/182 150/149 |
| 2016/0345697 | A1* | 12/2016 | Purwanto | A45C 11/182 |

* cited by examiner

MULTI-SLOT ACCESS WALLET

BACKGROUND OF THE INVENTION

This invention relates generally to wallets for carrying personal items and, more particularly, to a wallet having multiple slot access points to respective pockets arranged in a slim-line configuration that is easy to carry and access.

A wallet is a relatively small and flexible carrying case traditionally used to carry currency, credit cards, personal identification documents, insurance information, photographs, and the like. Conventional wallets are arranged as a bi-fold or tri-fold case having a single access point to a main pocket and then slots accessible from one side for insertion of cards. Some wallets have auxiliary transparent components configured to display photographs.

Although presumably effective for their intended purposes, traditional wallets quickly become bulky and important documents or cards become lost, difficult to find, and even more difficult to remove. Therefore, it would be desirable to have a lighter weight wallet having multiple thin sheets mounted one atop the other and defining multiple edge openings giving access to multiple internal pockets. Further, it would be desirable to have a lighter weight wallet in which each side edge provides an opening to a single pocket, each opening and pocket being displaced 90 degrees from a next pocket. In addition, it would be desirable to have a lighter weight wallet defining a slot or channel in at least a top sheet that enables the contents of a top pocket to be visible and to slide out with a swipe of the user's finger.

SUMMARY OF THE INVENTION

A multi-slot access wallet according to the present invention includes a substantially rectangular base sheet having a lower edge, a first side edge perpendicular to the lower edge, an upper edge parallel to the lower edge, and a second side edge parallel to the first side edge that connects ends of the upper and lower edge. The wallet includes a first intermediate sheet having a lower edge, a first side edge perpendicular to the lower edge, an upper edge parallel to the lower edge, and a second side edge parallel to the first side edge that connects ends of the upper and lower edges, wherein the first, second, and upper edges of the base sheet and the first intermediate sheet, respectively, being joined together and the lower edges of the base sheet and the first intermediate sheet, respectively, being unjoined, so as to form a first opening to a first pocket formed between the base sheet and the first intermediate sheet.

Additional intermediate sheets may be included in like fashion—each having edges joined or unjoined so as to form openings to additional pockets. Finally, a top sheet having a substantially similar configuration may be joined atop the uppermost intermediate sheet and defining an aperture or window configured to reveal the contents of an immediate preceeding pocket. Each respective pair of sheets defines an opening and pocket offset by 90 degrees from the prior pair of sheets such that each side of the wallet has a slot opening to a respective pocket. Each pocket is independent and not joined to any other pocket.

Therefore, a general object of this invention is to provide a multiple slot access wallet that enables the contents of the wallet to be inserted and removed from pockets accessible from respective side edges thereof.

Another object of this invention is to provide a multiple slot access wallet, as aforesaid, that enables contents to be accessed without first having to flip open the wallet in a conventional manner.

Yet another object of this invention is to provide a multiple slot access wallet, as aforesaid, that enables a user to slidably remove a document or card by manipulating the card through a slot in the top sheet.

Still another object of this invention is to provide a multiple slot access wallet, as aforesaid, that enables important documents to be viewed through a window or slot in a top sheet of the wallet.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
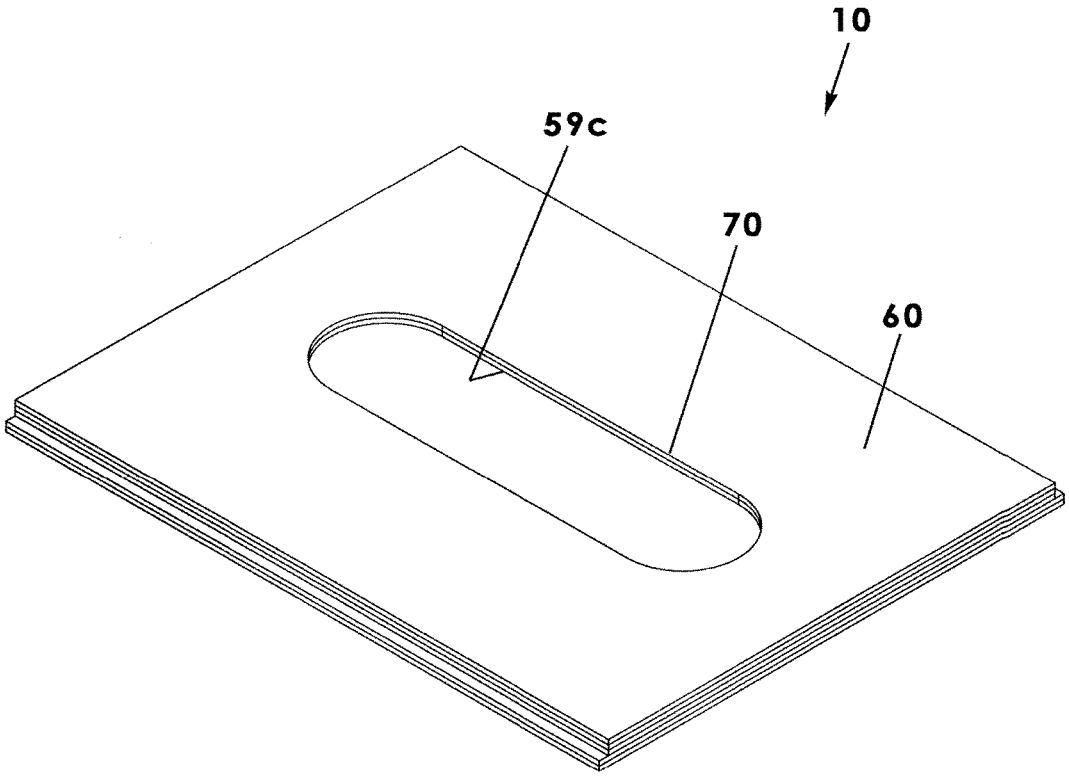
FIG. 1 is a perspective view of a multi-slot access wallet according to a preferred embodiment of the present invention.
Figure 2:
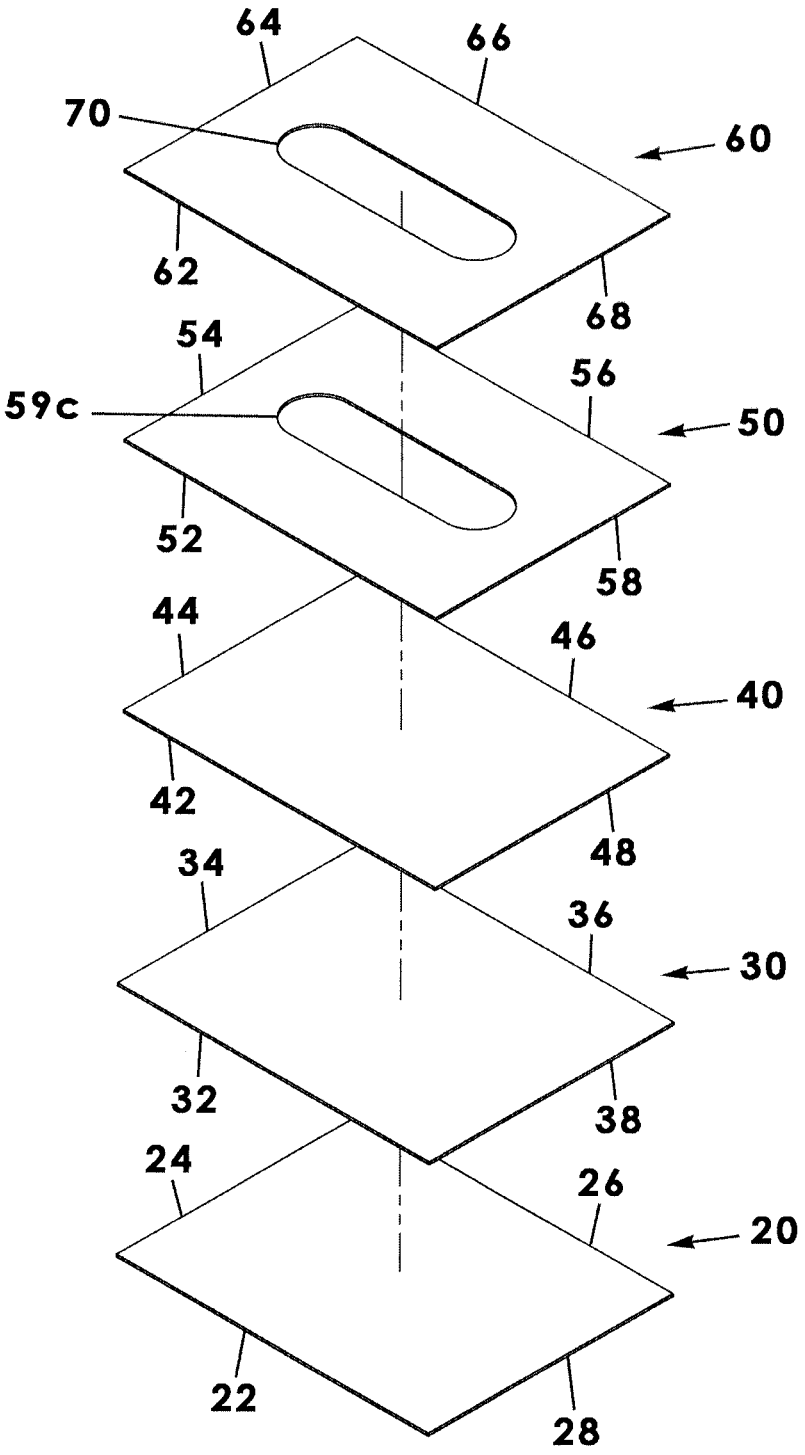
FIG. 2 is an exploded view of the wallet as in FIG. 1.

A multi-slot access wallet according to a preferred embodiment of the present invention will be described below with reference to FIGS. 1 to 7*c* of the accompanying drawings. The multi-slot access wallet 10 includes a base sheet 20, a first intermediate sheet 30, a second intermediate sheet 40, a third intermediate sheet, and a top sheet 60. It is understood that the number of intermediate sheets may be more or fewer in various embodiments of products introduced to the market.

The base sheet 20 preferably includes a substantially rectangular shaped configuration although other configurations would also work. In addition, all of the sheets described below are constructed of a flexible material having a very thin, planar, and lightweight configuration. Now, more particularly, the base sheet 20 may have a lower edge 22, a first side edge 24 perpendicular to said lower edge 22, an upper edge 26 parallel to said lower edge 22, and a second side edge 28 parallel to said first side edge that connects ends of said upper and lower edges.

The multi-slot access wallet 10 includes a plurality of intermediate sheets, each sheet having a configuration substantially similar to that of the base sheet 20, the sheets being joined together along respective peripheral edges as will be described below. In each instance, three of four edges are joined together and one edge is not joined, such that an opening to an interior pocket is formed. The sheets will be referenced specifically below as being indicative of a preferred embodiment but will also be referred to more generically as a reflection that embodiments having fewer or greater numbers of intermediate sheets are possible.

Figure 3A:
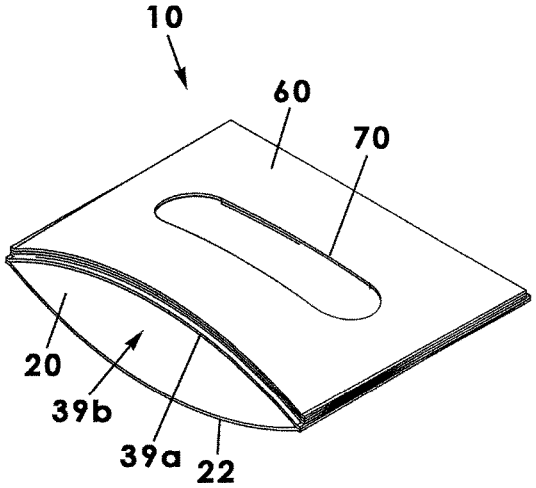
FIGS. 3*a* to 3*d* are perspective views of the wallet as in claim 1, each accenting the opening of a respective side pocket.

Specifically, a first intermediate sheet 30 includes a lower edge 32, a first side edge 34 perpendicular to said lower edge 32, an upper edge 36 parallel to said lower edge 32, and a second side edge 38 parallel to said first side edge 34 that connects ends of said upper and lower edges. In an embodiment, the first, second, and upper edges of the base sheet 20 and the first intermediate sheet 30, respectively, are joined together and said lower edges of the base sheet 20 and said first intermediate sheet 30, respectively, are unjoined, so as to form a first opening 39*a* to a first pocket 39*b* formed between the base sheet 20 and the first intermediate sheet 30 (FIG. 3*a*).

Figure 3B:
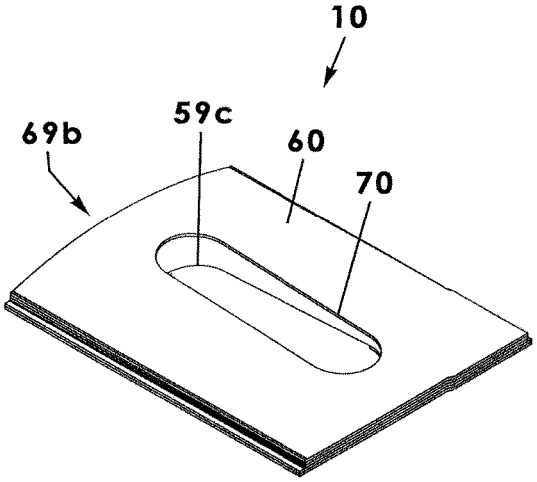
Figure 3C:
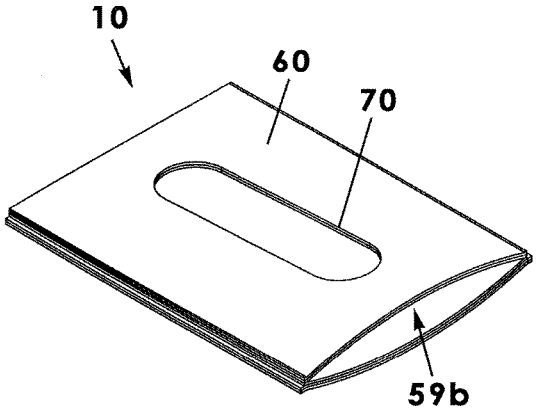
Figure 3D:
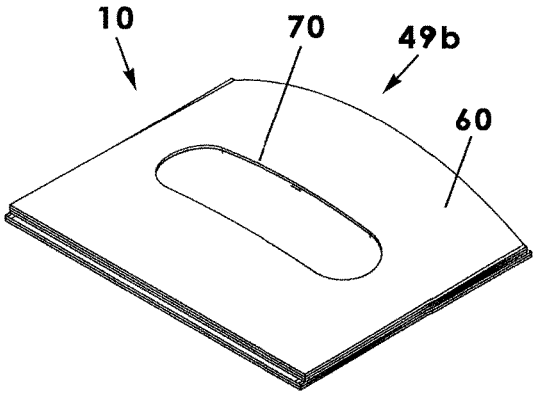
Figure 4:
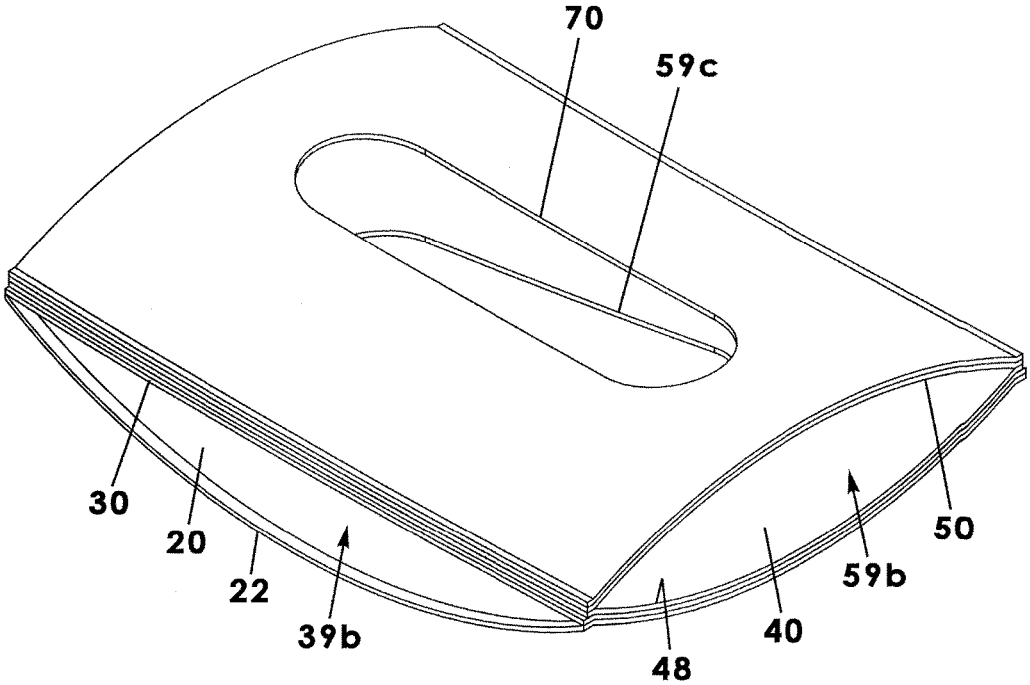
FIG. 4 is another perspective view of the wallet as in FIG. 1 on an enlarged scale and illustrated with multiple side pockets in an open configuration.
Figure 5:
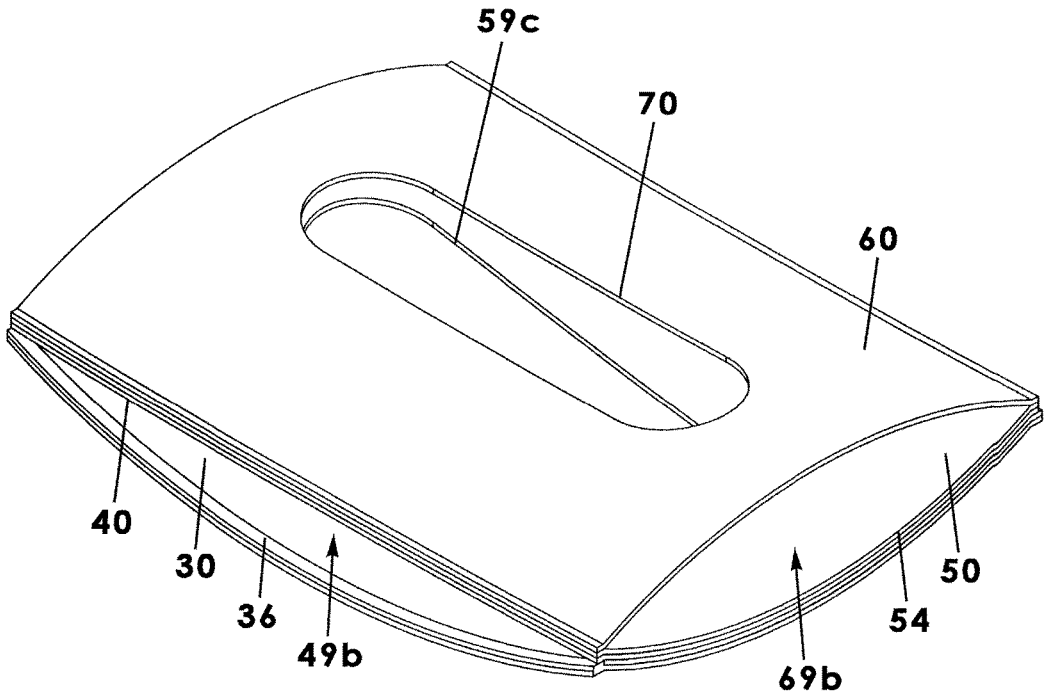
FIG. 5 is yet another view of the wallet as in FIG. 1 on an enlarged scale and illustrated with multiple side pockets in an open configuration.
Figure 6:
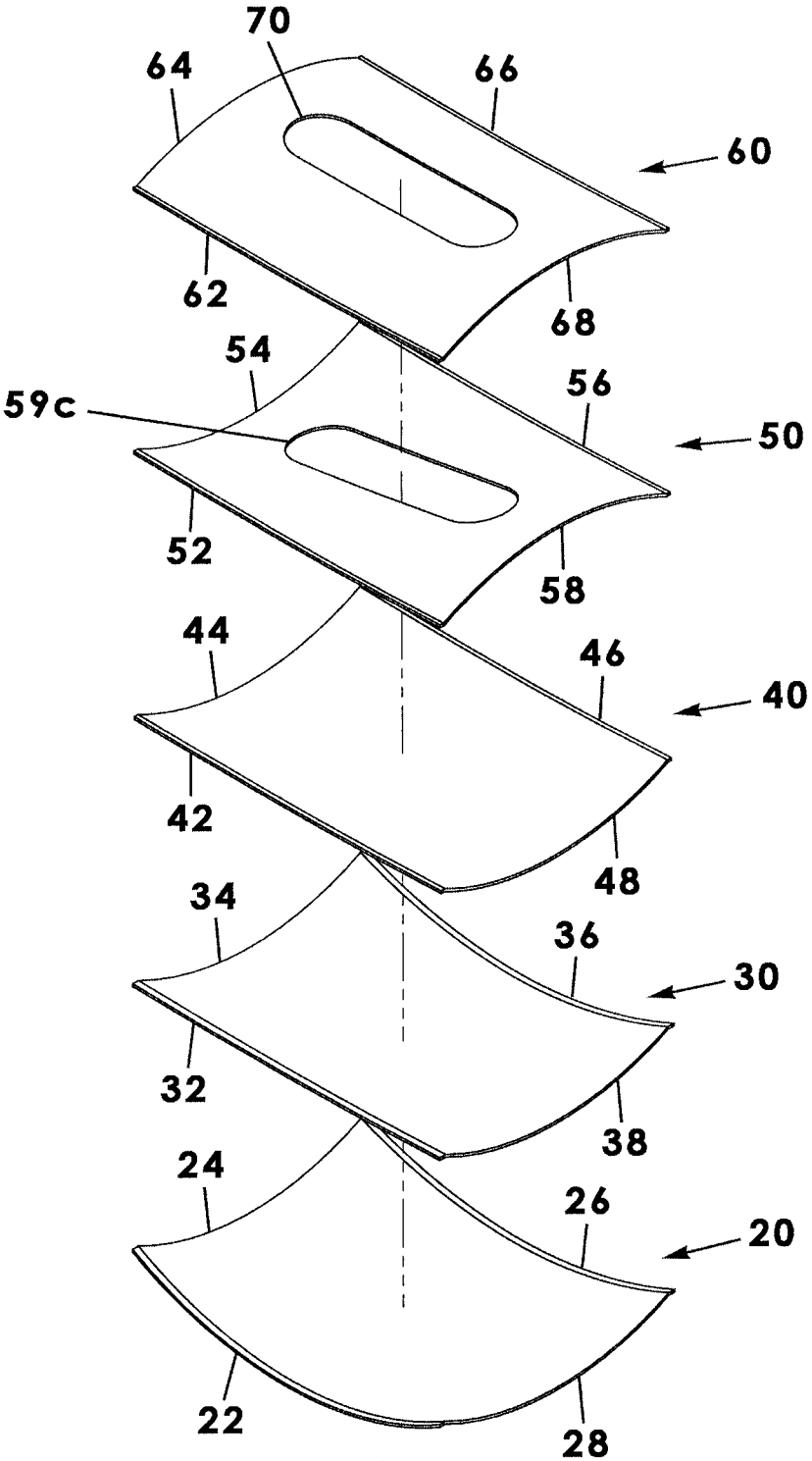
FIG. 6 is another exploded view of the wallet as in FIG. 1 illustrating each sheet flexed as it were in an open configuration.
Figure 7A:
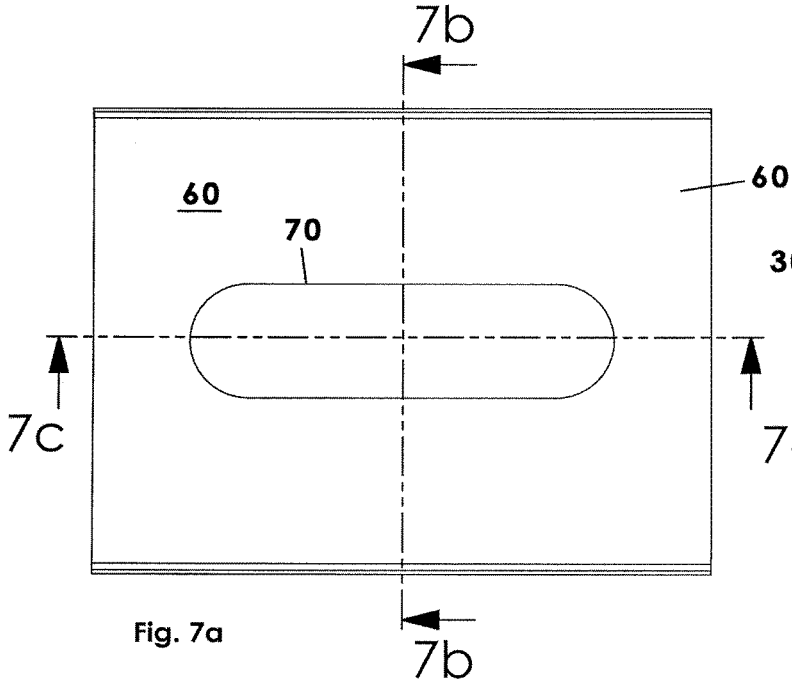
FIG. 7*a* is a top view of the wallet as in FIG. 1.
Figure 7B:
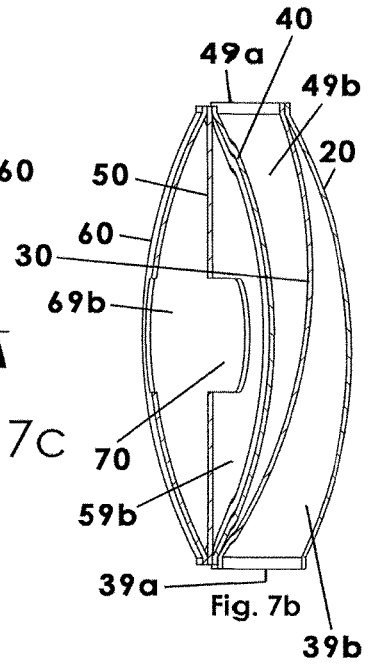
FIG. 7*b* is a sectional view taken along line 7*b*-7*b* of FIG. 7*a*.
Figure 7C:
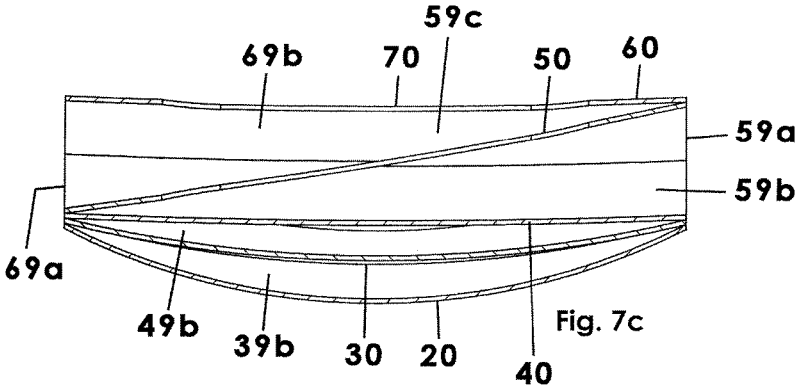
FIG. 7*c* is a sectional view taken along line 7*c*-7*c* of FIG. 7*a*.

Similarly, a second intermediate sheet 40 includes a lower edge 42, first side edge 44 perpendicular to said lower edge 42, an upper edge 46 parallel to said lower edge 42, and a second side edge 48 parallel to said first side edge 44 that connects ends of the upper and lower edges. In an embodiment, lower, first, and second edges of the first intermediate sheet 30 and the second intermediate sheet 40 are joined together and the upper edges of the first 30 and second 40 intermediate sheets, respectively, are unjoined so as to form a second opening 49*a* to a second pocket 49*b* defined between the first and second intermediate sheets (FIG. 3*d*).

Further, the plurality of intermediate sheets may include a third intermediate sheet 50 includes a lower edge 52, a first side edge 54 perpendicular to said lower edge 52, an upper edge 56 parallel to said lower edge 52, and a second side edge 58 parallel to said first side edge 54 that connects ends of the upper and lower edges. In an embodiment, the lower, first, and upper edges of the second 40 and third 50 intermediate sheets, respectively, are joined and the second edges of the second 40 and third 50 intermediate sheets are unjoined so as to form a third opening 59*a* to a third pocket 59*b* defined between the second and third intermediate sheets (FIG. 3*c*). It is understood that none of the openings or pockets described above are in communication with one another and are, in fact, offset from about 90 degrees one another.

The multi-slot access wallet 10 also includes a top sheet 60. Substantially similar to the plurality of intermediate sheets, the top sheet 60 may include a lower edge 62, a first side edge 64 perpendicular to the lower edge 62, an upper edge 66 parallel to the lower edge 62, and a second side edge 68 parallel to the first side edge 64 that connects ends of said upper and lower edges. Preferably, the lower, upper, and second edges of the third intermediate and the top sheet, respectively, are joined together. By contrast, corresponding first side edges of the third intermediate sheet 50 and the top sheet 60, respectively, are unjoined so as to form a fourth opening 69*a* to a fourth pocket 69*b* formed between the third intermediate sheet 50 and the top sheet 60 (FIG. 3*b*). Again, it is understood that the fourth pocket 69*b* is not in communication with any other pocket described above.

As shown, the top sheet 60 may define an aperture 70 through which contents in said fourth pocket 69*b* are visible—for example, a driver's license. More importantly, the aperture 70 is an opening that enables a user to use his finger or thumb to slide a card or document out of the respective pocket quickly and easily. The aperture 70 may have an elongate oval or rectangular shape configuration and extend substantially between opposed side edges. In an embodiment, both the top sheet 60 and third intermediate sheet 50 (i.e. the next lowerly adjacent intermediate sheet) may define aligned apertures 70, 59*a* so as to make the contents of both the fourth and third pockets visible.

Embodiments of the multi-slot access wallet 10 may include greater or fewer numbers of intermediate sheets between base and top sheets. Therefore, the multi-slot access wallet 10 may be described and recite more generally or generically as follows.

The base sheet 20, as described above, includes having a lower edge, a first side edge perpendicular to the lower edge, an upper edge parallel to the lower edge, and a second side edge parallel to the first side edge that connects ends of the upper and lower edge. Then, the multi-slot access wallet 10 may include a plurality of intermediate sheets, each intermediate sheet having a lower edge, a first side edge perpendicular to the lower edge, an upper edge parallel to the lower edge, and a second side edge parallel to the first side edge that connects ends of the upper and lower edges. Then, three corresponding edges taken from a group consisting of the lower edge, the first side edge, the upper edge, and the second side edge of the base sheet and the immediately upwardly adjacent intermediate sheet are joined together and a fourth corresponding edge of the base sheet and the immediately upwardly adjacent intermediate sheet, respectively, being unjoined, so as to form a first opening to a first pocket formed between the base sheet and the immediately upwardly adjacent intermediate sheet.

A top sheet 60, as described above, includes a lower edge, a first side edge perpendicular to the lower edge, an upper edge parallel to the lower edge, and a second side edge parallel to the first side edge that connects ends of the upper and lower edges. Then, it may be described that three corresponding edges taken from a group consisting of the lower edge, the first side edge, the upper edge, and the second side edge of the top sheet and the immediately lower adjacent intermediate sheet are joined together and a fourth corresponding edge of the top sheet and the immediately lower adjacent intermediate sheet, respectively, are unjoined, so as to form a top opening to a top pocket formed between the base sheet and the immediately lower adjacent intermediate sheet.

In an embodiment, at least the base sheet 20 and the top sheet 60 may be coated with a Radio Frequency Identification (RFID) blocking material. This material is known to foil nefarious attempts to read the magnetic strips or computer chips of credit cards in a wallet or purse. By surrounding the contents of the present wallet 10 with RFID blocking material, the contents therein are safer from identity theft.

In use, the usual contents carried in a wallet may be inserted into respective pockets through respective openings, each opening and pocket being offset about 90 degrees from each adjacent pocket. The arrangement of offset pocket openings is efficient and desirable for a user to quickly slide items, such as credit cards, paper currency, pictures, and the like into or out of the wallet. Further, important documents that need to be viewed visually, may be positioned in the uppermost pocket and viewed through the aperture 70 of the top sheet 60. Overall, the innovative multi-slot access wallet 10 is thinner and lighter weight than traditional more bulky wallets.

It is understood that while certain forms of this invention have been illustrated and described, it is not limited thereto except insofar as such limitations are included in the following claims and allowable functional equivalents thereof.

The invention claimed is:

1. A multi-slot access wallet, comprising:

a base sheet having a lower edge, a first side edge perpendicular to said lower edge, an upper edge parallel to said lower edge, and a second side edge parallel to said first side edge that connects ends of said upper and lower edge;

a plurality of intermediate sheets, each intermediate sheet having a lower edge, a first side edge perpendicular to said lower edge, an upper edge parallel to said lower edge, and a second side edge parallel to said first side edge that connects ends of said upper and lower edges, wherein three corresponding edges taken from a group consisting of said lower edge, said first side edge, said upper edge, and said second side edge of said base sheet and an immediately upwardly adjacent intermediate sheet are joined together and a fourth corresponding edge of said base sheet and said immediately upwardly adjacent intermediate sheet, respectively, are unjoined, so as to form a first opening to a first pocket formed between said base sheet and said immediately upwardly adjacent intermediate sheet;

three corresponding side edges taken from a group consisting of said lower edge, said first side edge, said upper edge, and said second side edge of respective adjacent intermediate sheets of said plurality of intermediate sheets are joined together and a fourth corresponding edge of respective adjacent intermediate sheets, respectively, remain unjoined, so as to form a next opening to a next pocket formed between said respective adjacent intermediate sheets;

wherein said first pocket and said next pocket are offset 90 degrees from one another and each subsequent next pocket is offset 90 degrees from an adjacent next pocket;

a top sheet having a lower edge, a first side edge perpendicular to said lower edge, an upper edge parallel to said lower edge, and a second side edge parallel to said first side edge that connects ends of said upper and lower edges, wherein three corresponding edges taken from a group consisting of said lower edge, said first side edge, said upper edge, and said second side edge of said top sheet and an immediately lower adjacent intermediate sheet are joined together and a fourth corresponding edge of said top sheet and said immediately lower adjacent intermediate sheet, respectively, are unjoined, so as to form a top opening to a top pocket formed between said base sheet and said immediately lower adjacent intermediate sheet;

wherein said base sheet, said plurality of intermediate sheets, and said top sheet define an upper pocket, a left side pocket, a lower pocket, and a right side pocket, each pocket being offset 90 degrees from any adjacent pocket.

2. The multi-slot access wallet as in claim 1, wherein said first pocket and said next pocket are not in communication with one another.

3. The multi-slot access wallet as in claim 1, wherein:

said top pocket is not in communication with any other pocket;

said top pocket is offset 90 degrees from any adjacent pocket;

said top sheet defines an aperture through which contents in said top pocket are visible and accessible.

4. The multi-slot access wallet as in claim 3, wherein said aperture extends longitudinally substantially between said first and second side edges of said top sheet.

5. The multi-slot access wallet as in claim 3, wherein one of said base sheet and said top sheet are coated with a radio frequency identification (RFID) blocking material.

* * * * *